US010627730B2

(12) United States Patent
Kuramochi

(10) Patent No.: US 10,627,730 B2
(45) Date of Patent: Apr. 21, 2020

(54) IMAGE FORMING METHOD AND IMAGE FORMING DEVICE

(71) Applicant: Konica Minolta, Inc., Tokyo (JP)

(72) Inventor: Kazuhiro Kuramochi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/059,292

(22) Filed: Aug. 9, 2018

(65) Prior Publication Data

US 2019/0094723 A1 Mar. 28, 2019

(30) Foreign Application Priority Data

Sep. 27, 2017 (JP) ..... 2017-185573

(51) Int. Cl.

| | |
|---|---|
| ***G03G 5/147*** | (2006.01) |
| ***G03G 5/043*** | (2006.01) |
| ***G03G 5/10*** | (2006.01) |
| ***G03G 5/05*** | (2006.01) |

(52) U.S. Cl.

CPC ..... *G03G 5/0433* (2013.01); *G03G 5/0553* (2013.01); *G03G 5/104* (2013.01); *G03G 5/1473* (2013.01); *G03G 5/14704* (2013.01); *G03G 5/14734* (2013.01); *G03G 5/14791* (2013.01); *G03G 5/14795* (2013.01)

(58) Field of Classification Search

CPC ..... G03G 5/147; G03G 5/14704; G03G 5/14734; G03G 13/04

See application file for complete search history.

(56) References Cited

U.S. PATENT DOCUMENTS

| | | | | |
|---|---|---|---|---|
| 6,009,286 A * | 12/1999 | Watanabe | ..... | G03G 15/1675 399/128 |
| 6,356,726 B1 * | 3/2002 | Campbell | ..... | G03G 15/169 399/107 |
| 2017/0261870 A1 * | 9/2017 | Yumita | ..... | G03G 5/0609 |

FOREIGN PATENT DOCUMENTS

| | | |
|---|---|---|
| JP | 2011221381 A | 11/2011 |
| JP | 2017067973 A | 4/2017 |

* cited by examiner

*Primary Examiner* — Peter L Vajda

(74) *Attorney, Agent, or Firm* — Lucas & Mercanti, LLP

(57) ABSTRACT

An image forming method forms an image by performing charging, exposing, developing, and transferring in a rotation direction of a rotationally driven photoreceptor, wherein the charging is performed by a roller charging method, exposing a surface of the photoreceptor to light and eliminating charges on the surface of the photoreceptor are included between the developing and the transferring, the photoreceptor includes at least a charge transporting layer and a protective layer laminated on the charge transporting layer on a conductive support, and energy of light for irradiation in the exposing the surface of the photoreceptor to light is in a range of 0.0001 to 500 $\mu W/mm^2$ on the surface of the photoreceptor.

6 Claims, 2 Drawing Sheets

IMAGE FORMING METHOD AND IMAGE FORMING DEVICE

The entire disclosure of Japanese patent Application No. 2017-185573, filed on Sep. 27, 2017, is incorporated herein by reference in its entirety.

BACKGROUND

Technological Field

The present invention relates to an image forming method and an image forming device. More specifically, the present invention relates to an image forming method and an image forming device capable of improving transfer memory tolerance deteriorated when a roller charging method is adopted and charging stability at the time of endurance in photographing while suppressing abrasion of a photoreceptor.

Description of the Related Art

In recent years, in order to improve a work environment of a user, a roller charging method with a small discharge amount of ozone has been adopted more and more. However, it is known that the roller charging method tends to significantly cause abrasion of an electrophotographic photoreceptor (hereinafter also referred to as a "photoreceptor") and further deteriorates transfer memory tolerance in comparison with a conventional corona discharge type charging method.

In addition, it is known that the roller charging method causes contamination of a charging roller due to long-term use and significantly reduces charging stability.

These are problems that have not occurred in the conventional corona discharge type charging system, for example, a scorotron charging system, and have become obvious as a peculiar problem in the roller charging method.

In order to solve these problems, various studies have been made so far. However, no technique has been invented which has solved problems in all of abrasion of a photoreceptor, transfer memory tolerance, and charging stability at the same time without side effects.

Conventionally, for example, in order to suppress abrasion of a surface of a photoreceptor, a technique of disposing a protective layer on an outermost surface of a photoreceptor has been developed, and a lifetime of the photoreceptor has been largely improved (see, for example, JP 2011-221381 A).

However, meanwhile, by disposing the protective layer, electrical characteristics of the photoreceptor are deteriorated, and in particular, transfer memory is significantly generated under a low temperature and low humidity environment disadvantageously. Therefore, in order to solve this problem, a technique for adding a charge transport agent to a protective layer has also been developed. However, the charge transport agent acts as a plasticizer for the protective layer, and an effect of suppressing abrasion of a photoreceptor cannot be sufficiently exhibited disadvantageously (for example, see JP 2017-67973 A).

Furthermore, contamination of a charging roller to reduce charging stability tends to be generated even if the strength of a photoreceptor is too high or too low, and therefore makes it more difficult to achieve both suppression of abrasion of a surface of the photoreceptor and transfer memory tolerance.

In addition, a technique for improving transfer memory by disposing a charge eliminating unit around a photoreceptor before cleaning and canceling charges on the photoreceptor has been developed. However, disadvantageously, the charge eliminating unit before cleaning generates a discharge product such as ozone excessively, and mounting models are limited because a sufficient space is required for disposing the charge eliminating unit.

SUMMARY

The present invention has been achieved in view of the above problems and circumstances, and an object of the present invention is to provide an image forming method and an image forming device capable of improving transfer memory tolerance deteriorated when a roller charging method is adopted and charging stability at the time of endurance in photographing while suppressing abrasion of a photoreceptor.

To achieve the abovementioned object, according to an aspect of the present invention, there is provided an image forming method, reflecting one aspect of the present invention, that forms an image by performing charging, exposing, developing, and transferring in a rotation direction of a rotationally driven photoreceptor, wherein the charging is performed by a roller charging method, exposing a surface of the photoreceptor to light and eliminating charges on the surface of the photoreceptor are included between the developing and the transferring, the photoreceptor includes at least a charge transporting layer and a protective layer laminated on the charge transporting layer on a conductive support, and energy of light for irradiation in the exposing the surface of the photoreceptor to light is in a range of 0.0001 to 500 $\mu W/mm^2$ on the surface of the photoreceptor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
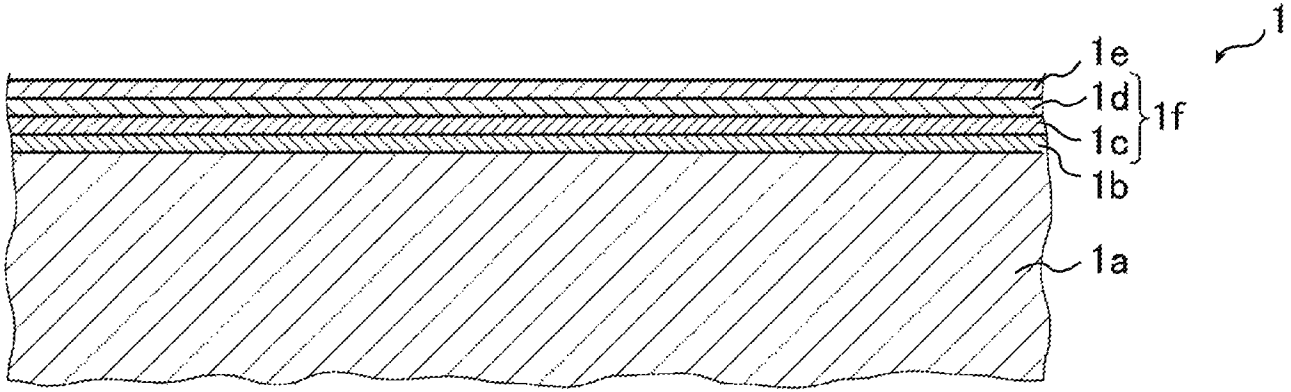
FIG. 1 is a partial cross-sectional view illustrating an example of a configuration of a photoreceptor according to an embodiment of the present invention.

Hereinafter, one or more embodiments of the present invention will be described with reference to the drawings. However, the scope of the invention is not limited to the disclosed embodiments.

An image forming method according to an embodiment of the present invention forms an image by performing a charging step, an exposing step, a developing step, and a transferring step in a rotation direction of a rotationally driven photoreceptor, and is characterized in that the charging step is performed by a roller charging method, a pre-transfer charge eliminating step that exposes a surface of the photoreceptor to light and eliminates charges on the surface of the photoreceptor is included between the developing step and the transferring step, the photoreceptor includes at least a charge transporting layer and a protective layer laminated on the charge transporting layer on a conductive support, and energy of light for irradiation in the pre-transfer charge eliminating step is in a range of 0.0001 to 500 $\mu W/mm^2$ on the surface of the photoreceptor. This characteristic is a technical characteristic common or corresponding to the following aspects.

In an aspect of the present invention, energy of light for irradiation in the pre-transfer charge eliminating step is preferably in a range of 0.01 to 50 $\mu W/mm^2$ on a surface of the photoreceptor from a viewpoint of minimizing generation of toner dust and obtaining the effect according to an embodiment of the present invention more effectively.

In an aspect of the present invention, light for irradiation in the pre-transfer charge eliminating step preferably contains light having a wavelength in a range of 550 to 900 nm because a charge generating layer has sensitivity for the light.

In an aspect of the present invention, the protective layer preferably contains inorganic fine particles from a viewpoint of improving durability of the protective layer.

In an aspect of the present invention, a surface of the protective layer preferably has a universal hardness in a range of 200 to 350 $N/mm^2$ from a viewpoint of effectively obtaining an effect of suppressing depletion of the protective layer.

In an aspect of the present invention, a surface of the protective layer preferably has a universal hardness in a range of 230 to 320 $N/mm^2$ from a viewpoint of more effectively obtaining an effect of suppressing depletion of the protective layer.

In an aspect of the present invention, the protective layer is preferably a cured product of a composition containing a polymerizable monomer from a viewpoint of improving durability of the protective layer.

In an aspect of the present invention, the inorganic fine particles preferably contain an inorganic oxide from a viewpoint of improving durability of the protective layer.

In an aspect of the present invention, the cured product is preferably a polymerized cured product of an acrylic monomer or a methacrylic monomer which is the polymerizable monomer, or a mixture thereof. This makes curing possible with a small amount of light or a short time.

In an aspect of the present invention, the inorganic fine particles preferably have a number average primary particle diameter in a range of 10 to 500 nm. When the number average primary particle diameter of the inorganic fine particles is in the above range, the protective layer can have sufficiently high film strength.

In addition, an image forming device according to an embodiment of the present invention includes a charger, an exposer, a developer, and a transferer in a rotation direction of a rotationally driven photoreceptor, and is characterized in that the charger includes a charging roller, a pre-transfer charge eliminator that exposes a surface of the photoreceptor to light and eliminates charges on the surface of the photoreceptor is disposed between the developer and the transferer, the photoreceptor includes at least a charge transporting layer and a protective layer laminated on the charge transporting layer on a conductive support, and energy of light for irradiation in the pre-transfer charge eliminator is in a range of 0.0001 to 500 $\mu W/mm^2$ on the surface of the photoreceptor.

Hereinafter, constituent elements of the present invention and an embodiment and an aspect for performing the present invention will be described in detail. Incidentally, in the present application, "to" means inclusion of numerical values described before and after "to" as a lower limit value and an upper limit value. In addition, in the following description, in a case where compounds are listed by way of specific examples, stereoisomers of the compounds are also included.

[Image Formation Method]

An image forming method according to an embodiment of the present invention forms an image by performing a charging step, an exposing step, a developing step, and a transferring step in a rotation direction of a rotationally driven photoreceptor. The charging step is performed by a roller charging method. A pre-transfer charge eliminating step that exposes a surface of the photoreceptor to light and eliminates charges on the surface of the photoreceptor is included between the developing step and the transferring step. The photoreceptor includes at least a charge transporting layer and a protective layer laminated on the charge transporting layer on a conductive support. Energy of light for irradiation in the pre-transfer charge eliminating step is in a range of 0.0001 to 500 $\mu W/mm^2$ on the surface of the photoreceptor.

After the transferring step, generally, a fixing step, a cleaning step, and a charge eliminating step are performed, and then subsequent image formation is performed. Hereinafter, each step will be described, and then a photoreceptor used in the present invention will be described.

<Charging Step>

This step is a step of charging a photoreceptor. The charging step according to an embodiment of the present invention is performed by a contact or non-contact roller charging method.

<Exposing Step>

In this step, an electrostatic latent image is formed on a photoreceptor (electrostatic latent image carrier).

The photoreceptor is not particularly limited, but examples thereof include a drum-shaped photoreceptor formed of a known organic photoreceptor.

The electrostatic latent image is formed by uniformly charging a surface of the photoreceptor with a charger and exposing the surface of the photoreceptor to light with an exposer so as to obtain an image shape.

The exposer is not particularly limited, and examples thereof include an exposer including an LED in which light emitting elements are arrayed in an axial direction of a photoreceptor and an imaging element and an exposer of a laser optical system.

<Developing Step>

In this step, an electrostatic latent image is developed with a developing agent containing toner to form a toner image.

The toner image can be formed with a dry developing agent containing toner, for example, using a rotating developing sleeve having a built-in magnet and holding the developing agent and a voltage applying device that applies a direct current and/or alternating current bias voltage between the developing sleeve and a photoreceptor. More specifically, toner and a carrier are mixed and stirred, the toner is charged by friction at this time, and the toner is held on a surface of a rotating magnet roller, and a magnetic brush is formed. The magnet roller is disposed near the photoreceptor. Therefore, a part of the toner constituting the magnetic brush formed on the surface of the magnet roller moves to a surface of the photoreceptor by an electric attraction force. As a result, the electrostatic latent image is developed with the toner and a toner image is formed on the surface of the photoreceptor.

<Transferring Step>

In this step, a toner image is transferred onto a recording medium.

The toner image is transferred onto the recording medium by causing peeling charge of the toner image on the recording medium.

Examples of the transferer include a corona transferring device by corona discharge, a transferring belt, and a transferring roller.

The transferring step also can be performed, for example, using an intermediate transfer member, by primarily transferring a toner image onto the intermediate transfer member and then secondarily transferring the toner image onto a recording medium, or by directly transferring a toner image formed on a photoreceptor onto a recording medium.

The recording medium is not particularly limited, and examples thereof include plain paper from thin paper to thick paper, high quality paper, coated printing paper such as art paper or coated paper, commercially available Japanese paper or postcard paper, an OHP plastic film, and a cloth.

<Pre-Transfer Charge Eliminating Step>

In this step, a surface of a photoreceptor is exposed to light, and charges on the surface of the photoreceptor are eliminated between the developing step and the transferring step. Energy of light for irradiation in the pre-transfer charge eliminating step is in a range of 0.0001 to 500 $\mu W/mm^2$, and more preferably in a range of 0.01 to 50 $\mu W/mm^2$ on the surface of the photoreceptor. The energy of the light can be measured by a known method, for example, by disposing an optical power meter (for example, model name: AQ-1135E OPTICAL POWER METER, manufactured by Ando Electric Co., Ltd.) on the surface of the photoreceptor.

The pre-transfer charge eliminating step eliminates a difference in surface potential between an image portion and a non-image portion on a photoreceptor after development, and thereby makes the amount of flowing of a transfer current into each of the image portion and the non-image portion of the photoreceptor uniform in primary transfer. This makes it possible to eliminate an image forming history of the photoreceptor in the first round and to suppress transfer memory of image forming in the second round. Furthermore, primary transferability is improved by making the transfer current uniform. Therefore, a transfer residual toner is reduced, and uneven abrasion of a cleaning blade can be suppressed. As a result, reduction in charging stability due to contamination of a charging roller can be suppressed.

Here, a surface potential is canceled immediately before primary transfer, and therefore toner dust tends to be generated disadvantageously. However, in the present invention, by setting the amount of light for irradiation in a range of 0.0001 to 500 $\mu W/mm^2$ on the surface of the photoreceptor, the effect according to an embodiment of the present invention can be obtained while generation of toner dust is suppressed. In addition, by setting the amount of light for irradiation in a range of 0.01 to 50 $\mu W/mm^2$ on the surface of the photoreceptor, generation toner dust can be minimized, and the effect according to an embodiment of the present invention can be more effectively obtained.

In addition, light for irradiation in the pre-transfer charge eliminating step preferably contains light having a wavelength in a range of 550 to 900 nm because a charge generating layer has sensitivity for the light.

<Fixing Step>

In the fixing step, a toner image transferred onto a recording medium is fixed to the recording medium. Specifically, for example, the fixing step is performed with a roller fixing type device including a fixing roller and a pressure roller disposed while being pressure-welded such that a fixing nip portion is formed on the fixing roller.

<Cleaning Step>

After the above step, the cleaning step of removing residual toner on a photoreceptor is performed.

In this step, a developing agent that has not been used for image formation or has not been transferred but remains on a developing agent carrier such as a photoreceptor or an intermediate transfer member is removed from the developing agent carrier.

A cleaning method is not particularly limited. However, it is preferable to use a method using a blade for abrading a surface of a photoreceptor, a tip of the blade being disposed in contact with the photoreceptor. For example, a configuration including a cleaning blade and a brush roller disposed on an upstream side of the cleaning blade can be used.

<Charge Eliminating Step>

In the charge eliminating step, a latent image on a surface of a photoreceptor is completely erased before a subsequent image is formed, for example, by exposure with light such as an LED. As a result, it is possible to reliably form a subsequent image. Note that the image forming method according to an embodiment of the present invention does not necessarily require the charge eliminating step and does not have to include the charge eliminating step.

<Photoreceptor>

A photoreceptor used in the image forming method according to an embodiment of the present invention includes at least a charge transporting layer and a protective layer laminated on the charge transporting layer on a conductive support.

In an example of a specific layer configuration of a photoreceptor 1 according to an embodiment of the present invention, as illustrated in FIG. 1, on a conductive support 1*a*, a charge generating layer 1*c* and a charge transporting layer 1*d* as photosensitive layers 1*f*, and a protective layer 1*e* are laminated in this order, and an intermediate layer 1*b* is disposed between the conductive support 1*a* and the photosensitive layers 1*f*, if necessary.

In another example of the photoreceptor according to an embodiment of the present invention, on a conductive support, an intermediate layer, a single layer having a charge generating function and a charge transporting function as a photosensitive layer, and a protective layer are laminated in this order.

(Protective Layer)

The protective layer constituting the photoreceptor according to an embodiment of the present invention is a layer for protecting a surface of the photoreceptor, and a known protective layer used for a photoreceptor can be used. The protective layer is constituted by a resin layer including a polymer compound. As the polymer compound, a general material such as a thermoplastic resin, a thermosetting resin, or a UV cured resin can be used. The polymer compound is preferably a cured product of a composition containing a polymerizable monomer from a viewpoint of improving durability of the protective layer. The cured product is more preferably a polymerized cured product of an acrylic monomer or a methacrylic monomer which is a polymerizable monomer, or a mixture thereof because curing is possible with a small amount of light or a short time. As a method for curing the polymerizable monomer, a general curing method can be used, but UV curing is preferable.

Specific examples of the acrylic monomer and methacrylic monomer used as a monomer for the resin layer (hereinafter referred to as a "cured resin") including the polymer compound according to an embodiment of the present invention include the following exemplified compounds (M1) to (M14).

Here, in the chemical formulas representing the exemplified compounds (M1) to (M14), R represents an acryloyl group ($CH_2{=}CHCO{-}$), and R' represents a methacryloyl group ($CH_2{=}CCH_3CO{-}$).

[Chemical formula 1]

M1

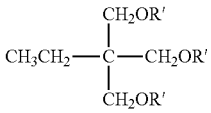

M2

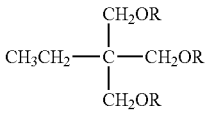

M3

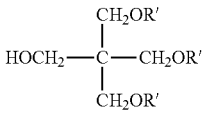

M4

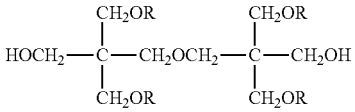

M5

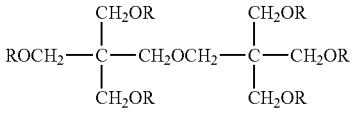

M6

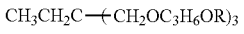

M7

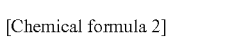

[Chemical formula 2]

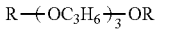

M8

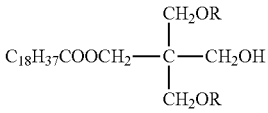

M9

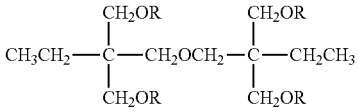

M10

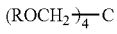

M11

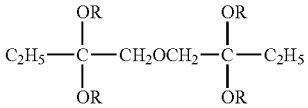

M12

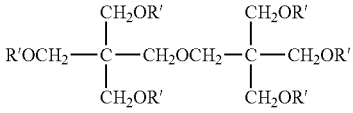

M13

-continued

M14

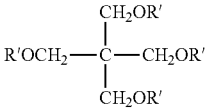

(Universal Hardness)

The protective layer according to an embodiment of the present invention preferably has a universal hardness in a range of 200 to 350 N/mm$^2$, more preferably in a range of 230 to 320 N/mm$^2$ on a surface of the protective layer from a viewpoint of obtaining an effect of suppressing depletion of the protective layer.

As a method for measuring the universal hardness according to an embodiment of the present invention, by applying a load F to a diamond quadrangular pyramid Vickers indenter under a test load with a universal hardness meter (for example, a ultrafine hardness test system "Fischer Scope H100" (manufactured by Fischer Instruments K.K.)", a surface of a protective layer is pushed, and the universal hardness can be determined as a universal hardness HU (N/mm$^2$) according to the following formula (A) using a pushing depth h and the load F. A Vickers indenter (quadrangular pyramid indenter, angle 136°), a pushing speed of 0.2 (mN/sec), a pushing load of 2 (mN), holding time of 5 seconds, measurement environment of 20° C. and 50% RH are used as measurement conditions.

$$HU(\text{universal hardness})=F/(26.45\times h^2) \qquad \text{Formula (A):}$$

(Inorganic Fine Particles)

The protective layer according to an embodiment of the present invention preferably contains inorganic fine particles from a viewpoint of improving durability of the protective layer. In addition, the inorganic fine particles preferably contain an inorganic oxide. At least a part of a surface of the inorganic oxide is preferably formed of a metal oxide, and may be constituted by a single material or a plurality of materials. Specific examples of the inorganic fine particles constituted by a plurality of materials include composite fine particles having a core-shell structure in which a metal oxide is attached to a surface of a core material as a coating material. In the composite fine particles having a core-shell structure, a part of the surface of the core material may be exposed, or the surface of the core material may be completely coated with the coating material.

Examples of the inorganic fine particles constituted by a single material include fine particles of silicon oxide (silica), magnesium oxide, zinc oxide, lead oxide, aluminum oxide (alumina), zirconium oxide, tin oxide, titanium oxide (titania), niobium oxide, molybdenum oxide, and vanadium oxide. Among these compounds, titanium oxide and tin oxide are preferable from viewpoints of hardness, conductivity, and light transmittance.

In a case where the inorganic fine particles are composite fine particles having a core-shell structure, an insulating material is used as the core material, and specific examples thereof include barium sulfate, silicon oxide, and aluminum oxide. Barium sulfate is particularly preferable as the core material from a viewpoint of light transmittance. Examples of the metal oxide as the coating material include tin oxide, titanium oxide, zinc oxide, zirconia, and indium tin oxide.

The amount of the metal oxide attached to the core material is preferably 30 to 80% by mass, and more preferably 40 to 70% by mass with respect to the core material.

As a method for attaching the metal oxide as the coating material to the core material, for example, a method disclosed in JP 2009-255042 A can be adopted.

As described above, since the inorganic fine particles are composite fine particles having a core-shell structure, it is possible to increase a particle diameter while securing conductivity and light transmittance.

Therefore, stability of electric characteristics and film strength can be improved.

The inorganic fine particles have volume resistivity preferably of $10^{-3}$ to $10^{7}$ Ωcm, more preferably of $10^{-1}$ to $10^{5}$ Ωcm.

The volume resistivity is a value measured by a TR8611A type digital super insulation resistance/micro ammeter manufactured by ADC Co., Ltd. under an environment of temperature of 23° C. and humidity of 50%.

The inorganic fine particles have a number average primary particle diameter preferably of 10 to 500 nm, more preferably of 20 to 250 nm.

By setting the particle diameter of the inorganic fine particles in the above range, the protective layer can have sufficiently high film strength.

In the present invention, the number average primary particle diameter of the inorganic fine particles is measured as follows.

First, a photosensitive layer including a protective layer is cut out from a surface of a photoreceptor with a knife or the like and pasted on an arbitrary holder such that the cut surface faces upward to manufacture a measurement sample. Then, an enlarged photograph of the measurement sample is taken with a scanning electron microscope (manufactured by JEOL Ltd.) at a magnification of 10000 times. 300 particles are randomly captured into a photographic image (excluding aggregated particles) by a scanner, and the number average primary particle diameter of the 300 particles is calculated using an automatic image processing analysis apparatus "LUZEX AP (software version Ver. 1.32)" (manufactured by Nireco).

The inorganic fine particles are contained in an amount preferably of 50 to 200 parts by mass, more preferably of 70 to 150 parts by mass with respect to 100 parts by mass of the cured resin.

By setting the content ratio of the inorganic fine particles in the above range, hardness, conductivity, and light transmittance can be satisfied sufficiently.

(Conductive Support)

A conductive support constituting the photoreceptor according to an embodiment of the present invention only needs to have conductivity, and specific examples thereof include a product obtained by molding a metal such as aluminum, copper, chromium, nickel, zinc, or stainless steel into a drum or sheet shape, a product obtained by laminating a metal foil such as aluminum or copper on a plastic film, a product obtained by vapor-depositing aluminum, indium oxide, tin oxide, or the like on a plastic film, and a metal, a plastic film, and paper having a conductive layer disposed by applying a conductive material alone or together with a binder resin.

(Intermediate Layer)

In the photoreceptor according to an embodiment of the present invention, an intermediate layer having a barrier function and an adhesive function is preferably disposed between the conductive support and the photosensitive layer from a viewpoint of preventing failure.

This intermediate layer contains, for example, a binder resin (hereinafter, also referred to as a "binder resin for an intermediate layer") and if necessary, metal oxide particles.

Examples of the binder resin for an intermediate layer include casein, polyvinyl alcohol, nitrocellulose, an ethylene-acrylic acid copolymer, a polyamide resin, a polyurethane resin, and gelatin. Among these compounds, the alcohol-soluble polyamide resin is preferable.

The metal oxide particles are used for adjusting resistance, and specific examples thereof include particles formed of various metal oxides such as alumina, zinc oxide, titanium oxide, tin oxide, antimony oxide, indium oxide, and bismuth oxide, and particles formed of indium oxide doped with tin, tin oxide doped with antimony, and zirconium oxide.

The metal oxide particles may be used singly or in admixture of two or more kinds thereof. In a case where two or more kinds are mixed, the metal oxide particles may be in a form of solid solution or fusion.

The metal oxide particles have a number average primary particle diameter preferably of 0.3 μm or less, more preferably of 0.1 μm or less.

The content ratio of the metal oxide particles in the intermediate layer is preferably 20 to 400 parts by mass, and more preferably 50 to 350 parts by mass with respect to 100 parts by mass of the binder resin for an intermediate layer.

The intermediate layer has a layer thickness preferably of 0.1 to 15 μm, more preferably of 0.3 to 10 μm.

(Photosensitive Layer)

Regarding the photosensitive layer constituting the photoreceptor according to an embodiment of the present invention, a photosensitive layer including a charge generating layer and a charge transporting layer will be described in detail.

(Charge Generating Layer)

The charge generating layer in the photosensitive layer constituting the photoreceptor according to an embodiment of the present invention contains a charge generating material and a binder resin (hereinafter also referred to as a "binder resin for a charge generating layer").

As the binder resin for a charge generating layer, a known resin can be used, and specific examples thereof include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, a copolymer resin containing two or more of these resins (for example, a vinyl chloride-vinyl acetate copolymer resin or a vinyl chloride-vinyl acetate-maleic anhydride copolymer resin), and a poly-vinyl carbazole resin. Among these resins, the polyvinyl butyral resin is preferable.

The charge generating material is not particularly limited, and specific examples thereof include: an azo pigment such as Sudan Red or Diane Blue; a quinone pigment such as pyrenequinone or anthanthrone; a quinocyanine pigment; a perylene pigment; an indigo pigment such as indigo or thioindigo; a polycyclic quinone pigment such as pyranthrone or diphthaloyl pyrene; and a phthalocyanine pigment. Among these compounds, the polycyclic quinone pigment and the titanyl phthalocyanine pigment are preferable. These compounds can be used singly or in admixture of two or more kinds thereof.

The content ratio of the charge generating material in the charge generating layer is preferably 1 to 600 parts by mass, and more preferably 50 to 500 parts by mass with respect to 100 parts by mass of the binder resin for a charge generating layer.

The layer thickness of the charge generating layer is appropriately determined according to the characteristics of the binder resin for a charge generating layer, the characteristics and content ratio of the charge generating material, and the like, but is preferably 0.01 to 5 μm, and more preferably 0.05 to 3 μm.

(Charge Transporting Layer)

The charge transporting layer in the photosensitive layer constituting the photoreceptor according to an embodiment of the present invention contains a charge transporting material and a binder resin (hereinafter also referred to as a "binder resin for a charge transporting layer").

As the binder resin for a charge transporting layer, a known resin can be used, and specific examples thereof include a polycarbonate resin, a polyacrylate resin, a polyester resin, a polystyrene resin, a styrene-acrylonitrile copolymer resin, a polymethacrylate resin, and a styrene-methacrylate copolymer resin, but the polycarbonate resin is preferable. Furthermore, as the polycarbonate resin, a bisphenol A (BPA) type, a bisphenol Z (BPZ) type, a dimethyl BPA type, and a BPA-dimethyl BPA copolymer type are preferable from viewpoints of crack resistance, abrasion resistance, and charging characteristics.

As the charge transporting material, examples of a material that transports charges (holes) include a triphenylamine derivative, a hydrazone compound, a styryl compound, a benzidine compound, and a butadiene compound.

The content ratio of the charge transporting material in the charge transporting layer is preferably 10 to 500 parts by mass, and more preferably 20 to 250 parts by mass with respect to 100 parts by mass of the binder resin for a charge transporting layer.

The layer thickness of the charge transporting layer varies depending on the characteristics of the binder resin for a charge transporting layer, the characteristics and content ratio of the charge transporting material, and the like, but is preferably 5 to 40 μm, and more preferably 10 to 30 μm.

The charge transporting layer may include an antioxidant, an electron conducting agent, a stabilizer, a silicone oil, or the like.

An antioxidant disclosed in JP 2000-305291 A or the like is preferable, and an electron conducting agent disclosed in JP 50-137543 A, JP 58-76483 A, or the like is preferable.

<Method for Manufacturing Photoreceptor>

Concerning the photoreceptor according to an embodiment of the present invention, for example, a photoreceptor in which an intermediate layer, a photosensitive layer (specifically, a charge generating layer and a charge transporting layer), and a protective layer are laminated in this order on a conductive support can be manufactured through the following steps.

Step (1): a step of applying an intermediate layer forming coating liquid to an outer peripheral surface of a conductive support and drying the intermediate layer forming coating liquid to form an intermediate layer Step (2): a step of applying a charge generating layer forming coating liquid to an outer peripheral surface of an intermediate layer formed on a conductive support and drying the charge generating layer forming coating liquid to form a charge generating layer Step (3): a step of applying a charge transporting layer forming coating liquid to an outer peripheral surface of a charge generating layer formed on an intermediate layer and drying the charge transporting layer forming coating liquid to form a charge transporting layer Step (4): a step of applying a protective layer forming coating liquid (protective layer forming composition) to an outer peripheral surface of a charge transporting layer formed on a charge generating layer to form a coating film, and curing the coating film to form a protective layer (Step (1): Formation of Intermediate Layer)

In this step (1), a binder resin for an intermediate layer is dissolved in a solvent to prepare an intermediate layer forming coating liquid, metal oxide particles are dispersed therein, if necessary, then the intermediate layer forming coating liquid is applied onto a conductive support at a constant film thickness to form a coating film, and the coating film is dried to form an intermediate layer.

A means for dispersing the metal oxide particles in the intermediate layer forming coating liquid is not particularly limited, and examples thereof include an ultrasonic dispersing machine, a ball mill, a sand mill, and a homomixer.

Examples of a method for applying the intermediate layer forming coating liquid include a known method such as a dip coating method, a spray coating method, a spinner coating method, a bead coating method, a blade coating method, a beam coating method, a slide hopper method, or a circular slide hopper method.

A method for drying a coating film can be appropriately selected depending on the type of a solvent and a film thickness, but thermal drying is preferable.

As a solvent used in a step of forming the intermediate layer, a solvent that favorably disperses the metal oxide particles and dissolves the binder resin for an intermediate layer is preferable.

As a solvent used in a case where an alcohol-soluble polyamide resin is used as the binder resin for an intermediate layer in the step of forming the intermediate layer, an alcohol having 1 to 4 carbon atoms, such as methanol, ethanol, n-propyl alcohol, isopropyl alcohol, n-butanol, t-butanol, or sec-butanol, is preferable because of excellent solubility of a polyamide resin and excellent coating performance. Examples of a co-solvent that can be used in combination with the above-described solvent and can obtain a preferable effect in order to improve storage stability and dispersibility of the particles include benzyl alcohol, toluene, dichloromethane, cyclohexanone, and tetrahydrofuran.

The concentration of the binder resin for an intermediate layer in the intermediate layer forming coating liquid is appropriately selected according to the layer thickness of the intermediate layer and a manufacturing rate.

(Step (2): Formation of Charge Generating Layer)

In this step (2), a charge generating material is dispersed in a solution in which a binder resin for a charge generating layer is dissolved in a solvent to prepare a charge generating layer forming coating liquid, the charge generating layer forming coating liquid is applied onto an intermediate layer at a constant film thickness to form a coating film, and the coating film is dried to form a charge generating layer.

A means for dispersing the charge generating material in the charge generating layer forming coating liquid is not particularly limited, and examples thereof include an ultrasonic dispersing machine, a ball mill, a sand mill, and a homomixer.

Examples of a method for applying the charge generating layer forming coating liquid include a known method such as a dip coating method, a spray coating method, a spinner coating method, a bead coating method, a blade coating method, a beam coating method, a slide hopper method, or a circular slide hopper method.

A method for drying a coating film can be appropriately selected depending on the type of a solvent and a film thickness, but thermal drying is preferable.

A solvent used for forming the charge generating layer is not particularly limited, and examples thereof include toluene, xylene, dichloromethane, 1,2-dichloroethane, methyl ethyl ketone, cyclohexane, ethyl acetate, t-butyl acetate, methanol, ethanol, propanol, butanol, methyl cellosolve, 4-methoxy-4-methyl-2-pentanone, ethyl cellosolve, tetrahydrofuran, 1,4-dioxane, 1,3-dioxolane, pyridine, and diethylamine (Step (3): Formation of Charge Transporting Layer)

In this step (3), a charge transporting layer forming coating liquid in which a binder resin for a charge transporting layer and a charge transporting material are dissolved in a solvent is prepared, the charge transporting layer forming coating liquid is applied onto a charge generating layer at a constant film thickness to form a coating film, and the coating film is dried to form a charge transporting layer.

Examples of a method for applying the charge transporting layer forming coating liquid include a known method such as a dip coating method, a spray coating method, a spinner coating method, a bead coating method, a blade coating method, a beam coating method, a slide hopper method, or a circular slide hopper method.

A method for drying a coating film can be appropriately selected depending on the type of a solvent and a film thickness, but thermal drying is preferable.

A solvent used for forming the charge transporting layer is not particularly limited, and examples thereof include toluene, xylene, dichloromethane, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine (Step (4): Formation of Protective Layer)

In this step (4), a monomer for a cured resin, a polymerization initiator (a radical polymerization initiator), and if necessary, another component (for example, inorganic particles) are added to a solvent to prepare a protective layer forming composition. This protective layer forming composition is used as a coating liquid and applied to an outer peripheral surface of the charge transporting layer formed in step (3) to form a coating film. Then, by irradiating the obtained coating film with an actinic ray to cure a monomer component for a cured resin in the coating film, specifically to cure the monomer component by a polymerization reaction. A protective layer is thereby formed.

The monomer for a cured resin used for preparing the protective layer forming composition may be oligomerized.

Specific examples of a solvent constituting the protective layer forming composition include methanol, ethanol, n-propyl alcohol, isopropyl alcohol, n-butanol, t-butanol, sec-butanol, benzyl alcohol, toluene, xylene, dichloromethane, methyl ethyl ketone, cyclohexane, ethyl acetate, butyl acetate, methyl cellosolve, ethyl cellosolve, tetrahydrofuran, 1,4-dioxane, 1,3-dioxolane, pyridine, and diethylamine Examples of a method for applying the protective layer forming composition include a known method such as a dip coating method, a spray coating method, a spinner coating method, a bead coating method, a blade coating method, a beam coating method, a slide hopper method, or a circular slide hopper method. Among these methods, the circular slide hopper method is preferable.

Examples of a method for curing the monomer for a cured resin include a method for curing the monomer by causing a polymerization reaction by electron beam cleaving, and a method for curing the monomer by adding a radical polymerization initiator, and irradiating the monomer with an actinic ray such as an electron beam or an ultraviolet ray to cause a polymerization reaction by light or heat.

As the radical polymerization initiator, either a photopolymerization initiator or a thermal polymerization initiator can be used, and a photopolymerization initiator and a thermal polymerization initiator can be used in combination.

The photopolymerization initiator and the thermal polymerization initiator may be used singly or in admixture of two or more kinds thereof.

As the polymerization initiator (radical polymerization initiator), a photopolymerization initiator is preferable, and in particular, an alkylphenone-based compound or a phosphine oxide-based compound is preferable. In particular, a compound having an α-hydroxyacetophenone structure or an acylphosphine oxide structure is preferable.

Specific examples of the compound having an acylphosphine oxide structure (acylphosphine oxide-based compound) used as a photopolymerization initiator include the following exemplified compounds (P1) and (P2).

[Chemical formula 3]

P1

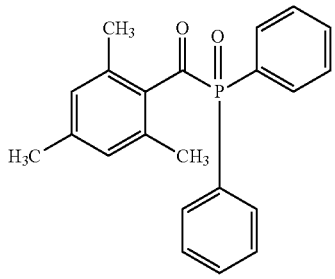

P2

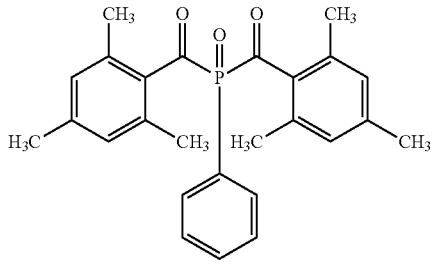

An addition ratio of the polymerization initiator is preferably 0.1 to 20 parts by mass, and more preferably 0.5 to 10 parts by mass with respect to 100 parts by mass of the monomer for a cured resin.

As the actinic ray, an ultraviolet ray and an electron ray are preferable, and the ultraviolet ray is particularly preferable from a viewpoint of usability.

When a coating film containing a polymerization initiator is irradiated with an actinic ray, a radical is generated in the coating film to cause a polymerization reaction. In addition, a crosslinking bond is formed by a crosslinking reaction intermolecularly and intramolecularly to cause curing. As a result, a cured resin (crosslinking type cured resin) is generated.

Any light source of an ultraviolet ray can be used as long as generating an ultraviolet ray, and examples thereof include a low-pressure mercury lamp, a medium-pressure mercury lamp, a high-pressure mercury lamp, an extra high-pressure mercury lamp, a carbon arc lamp, a metal halide lamp, a xenon lamp, and a flash (pulse) xenon lamp.

Ultraviolet irradiation conditions vary depending on the type of light source of an ultraviolet ray. However, an irradiation dose of an actinic ray is usually 5 to 500 mJ/cm$^2$, and preferably 5 to 100 mJ/cm$^2$, and electric power of a lamp is preferably 0.1 to 5 kW, and particularly preferably 0.5 to 3 kW.

As an electron beam source, any electron beam irradiation device can be used without being particularly limited. In general, a curtain beam type electron beam accelerator for electron beam irradiation that is relatively inexpensive and can obtain a large output is suitably used.

An accelerating voltage at the time of irradiation with an electron beam is preferably 100 to 300 kV. An absorption dose is preferably 0.5 to 10 Mrad.

Irradiation time for obtaining an irradiation dose of an actinic ray required for curing is preferably 0.1 seconds to 10 minutes, and more preferably 0.1 seconds to 5 minutes from a viewpoint of operation efficiency.

In the step of forming the protective layer, drying can be performed before and after irradiation with an actinic ray and during irradiation with an actinic ray, and the timing of drying can be appropriately selected by combining these.

[Image Forming Device]

Hereinafter, an image forming device according to an embodiment of the present invention capable of performing the above image forming method will be described.

An image forming device according to an embodiment of the present invention includes a charger, an exposer, a developer, and a transferer in a rotation direction of a rotationally driven photoreceptor. The charger includes a charging roller. A pre-transfer charge eliminator that exposes a surface of the photoreceptor to light and eliminates charges on the surface of the photoreceptor is disposed between the developer and the transferer. The photoreceptor includes at least a charge transporting layer and a protective layer laminated on the charge transporting layer on a conductive support. Energy of light for irradiation in the pre-transfer charge eliminator is in a range of 0.0001 to 500 μW/mm$^2$ on the surface of the photoreceptor.

In the image forming device according to an embodiment of the present invention, a known configuration can be suitably adopted except for the photoreceptor described above, a pre-transfer charge eliminator 14 described below, and a charger described below as long as exhibition of the effect according to an embodiment of the present invention is not hindered.

Figure 2:
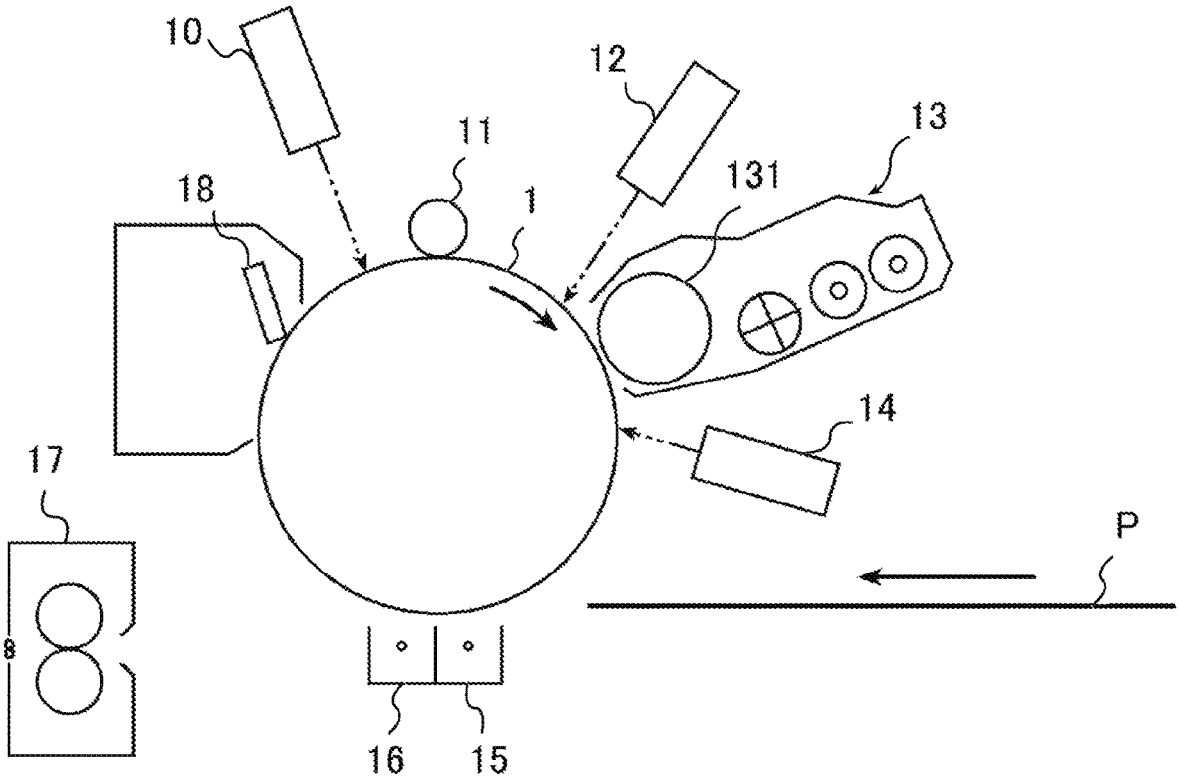
FIG. 2 is a schematic view illustrating an example of a configuration of an image forming device according to an embodiment of the present invention.

FIG. 2 is an explanatory cross-sectional view exemplifying the image forming device according to an embodiment of the present invention.

This image forming device includes: the photoreceptor 1 according to an embodiment of the present invention; a charger including a charging roller 11 that imparts a uniform potential to a surface of the photoreceptor 1 by corona discharge or the like having the same polarity as toner; an exposer 12 that performs image exposure on the uniformly charged surface of the photoreceptor 1 based on image data with a polygon mirror or the like to form an electrostatic latent image; a developer 13 that includes a rotating developing sleeve 131 and conveys toner held on the developing sleeve 131 to the surface of the photoreceptor 1 to visualize the electrostatic latent image to form a toner image; a pre-transfer charge eliminator 14 that exposes the surface of the photoreceptor 1 to light and eliminates charges on the surface of the photoreceptor 1; a transferer 15 that transfers the toner image onto an image support P, if necessary; a separator 16 that separates the image support P from the photoreceptor 1; a fixer 17 that fixes the toner image on the image support P; a cleaner 18 including a cleaning blade that removes residual toner on the photoreceptor 1; and a charge eliminator 10 that erases the latent image on the photoreceptor 1.

<Charger>

The charging roller 11 as the charger adopts a roller charging method as a charging method thereof and can use either contact roller charging or non-contact roller charging. A voltage to be applied can be either alternating current voltage (AC roller charging) or direct current voltage (DC roller charging). However, the effect according to an embodiment of the present invention is more remarkably exhibited by the AC roller charging method.

<Pre-Transfer Charge Eliminator>

The pre-transfer charge eliminator 14 eliminates charges by irradiating the surface of the photoreceptor 1 on which a toner image is formed with exposure light. As the pre-transfer charge eliminator 14, an exposure device including an LED in which light emitting elements are arrayed in an axial direction of the photoreceptor 1 and an imaging element, an exposure device of a laser optical system, and the like can be used.

As the pre-transfer charge eliminator 14, a light source that emits light having a wavelength at which the charge generating layer of the photoreceptor has sensitivity can be used. In the present invention, the light emitted by the pre-transfer charge eliminator preferably includes light having a wavelength in a range of 550 to 900 nm.

The embodiment of the present invention has been specifically described above, but the embodiment of the present invention is not limited to the above examples, and various modifications can be made thereto.

Example 1

Hereinafter, the present invention will be specifically described with reference to Examples, but the present invention is not limited thereto. Incidentally, an expression of "part" or "%" used in Examples means "part by mass" or "% by mass" unless otherwise specified.

[Manufacture of Photoreceptor]

(1) Conductive Support

A surface of an aluminum cylinder having a diameter of 30 mm was cut to prepare a conductive support [1] having a finely roughened surface.

(2) Formation of Intermediate Layer

A dispersion containing 1 part by mass of a polyamide resin "CM8000" (manufactured by Toray Industries, Inc.) as a binder resin, 3 parts by mass of titanium oxide "SMT500SAS" (manufactured by Tayca Corporation) as metal oxide particles, and 10 parts by mass of methanol as a solvent was diluted two times with methanol. The diluted solution was allowed to stand overnight and then filtered (filter; Rigimesh 5 μm filter manufactured by Pall Corporation was used) to prepare an intermediate layer forming coating liquid [1].

The intermediate layer forming coating liquid [1] thus obtained was applied onto the conductive support [1] by a dip coating method to form an intermediate layer [1] having a dry film thickness (layer thickness) of 2 μm.

(3) Formation of Charge Generating Layer 20 parts by mass of the following pigment (CG-1) as a charge generating material, 10 parts by mass of a polyvinyl butyral resin "#6000-C" (manufactured by Denka Corp.) as a binder resin, and 700 parts by mass of t-butyl acetate and 300 parts by mass of 4-methoxy-4-methyl-2-pentanone as a solvent were mixed and dispersed for 10 hours using a sand mill to prepare a charge generating layer forming coating liquid [1].

The charge generating layer forming coating liquid [1] thus obtained was applied onto the intermediate layer [1] by a dip coating method to form a charge generating layer [1] having a dry film thickness (layer thickness) of 0.3 μm.

(3-1) Synthesis of Pigment (CG-1)

(Synthesis of Amorphous Titanyl Phthalocyanine)

29.2 parts by mass of 1,3-diiminoisoindoline was dispersed in 200 parts by mass of o-dichlorobenzene. 20.4 parts by mass of titanium tetra-n-butoxide was added thereto, and the resulting mixture was heated at 150 to 160° C. for five hours under a nitrogen atmosphere. The resulting solution was allowed to cool. Thereafter, the precipitated crystal was filtered, washed with chloroform, washed with a 2% hydrochloric acid aqueous solution, washed with water, washed with methanol, and dried to obtain 26.2 parts by mass (yield 91%) of crude titanyl phthalocyanine Subsequently, the crude titanyl phthalocyanine was stirred in 250 parts by mass of concentrated sulfuric acid at 5° C. or lower for one hour to be dissolved, and the resulting solution was poured into 5000 parts by mass of water at 20° C. The precipitated crystal was filtered and thoroughly washed with water to obtain 225 parts by mass of a wet paste product.

The obtained wet paste product was frozen in a freezer and thawed again, and then filtered and dried to obtain 24.8 parts by mass (yield 86%) of amorphous titanyl phthalocyanine.

(Synthesis of (2R,3R)-2,3-Butanediol Adduct Titanyl Phthalocyanine (Pigment (CG-1))

10.0 parts by mass of the amorphous titanyl phthalocyanine and 0.94 parts by mass (0.6 equivalent ratio) (equivalent ratio to titanyl phthalocyanine, hereinafter the same) of (2R,3R)-2,3-butanediol were mixed with 200 parts by mass of orthodichlorobenzene (ODB). The resulting mixture was heated and stirred at 60 to 70° C. for 6.0 hours. The resulting solution was allowed to stand overnight. Thereafter, methanol was added thereto, and the resulting crystal was filtered and washed with methanol to obtain 10.3 parts by mass of a pigment (CG-1) (pigment containing (2R,3R)-2,3-butanediol adduct titanyl phthalocyanine)

The obtained pigment (CG-1) was analyzed. As a result, in an X-ray diffraction spectrum, distinct peaks appeared at 8.3°, 24.7°, 25.1°, and 26.5°. In a mass spectrum, peaks appeared at 576 and 648. In an IR spectrum, an absorption spectrum of Ti═O appeared around 970 $cm^{-1}$ and an absorption spectrum of O—Ti—O appeared around 630 $cm^{-1}$. In thermal analysis (TG), a mass reduction of about 7% was observed at 390 to 410° C. From these analysis results, the pigment (CG-1) is estimated to be a mixture of a 1:1 adduct of titanyl phthalocyanine and (2R,3R)-2,3-butanediol and non-adduct (addition was not performed) titanyl phthalocyanine The BET specific surface area of the obtained pigment (CG-1) was measured with a fluid type specific surface area automatic measuring apparatus (micrometrics/flow sorb type: Shimadzu Corporation), and was 31.2 $m^2/g$.

(4) Formation of Charge Transporting Layer

The following raw materials were mixed and dissolved to prepare a charge transporting layer forming coating liquid [1].

Charge transporting material: 225 parts by mass of the following compound CTM

Binder resin for charge transporting layer: 300 parts by mass of polycarbonate resin "Z300" (manufactured by Mitsubishi Gas Chemical Company, Inc.)

Antioxidant: 6 parts by mass of "Irganox1010" (manufactured by BASF Japan)

Solvent: 1600 parts by mass of tetrahydrofuran

Solvent: 400 parts by mass of toluene

Leveling agent: 1 part by mass of silicone oil "KF-54" (manufactured by Shin-Etsu Chemical Co., Ltd.)

The charge transporting layer forming coating liquid [1] was applied onto the charge generating layer [1] using a circular slide hopper applicator to form a coating film, and the coating film was dried to form a charge transporting layer [1] having a layer thickness of 28 μm.

[Chemical formula 4]

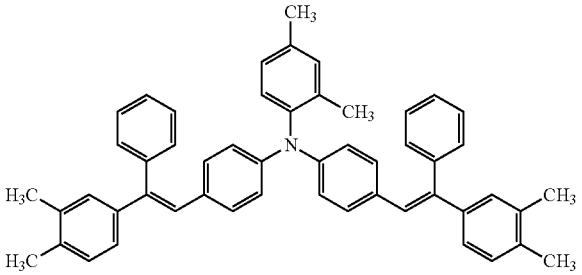

CTM

Up to the above, similar operations were performed to manufacture the following photoreceptors.

<Manufacture of Photoreceptor Used in Image Forming Methods 1, 15 to 19, and 22>

Under light shielding, 100 parts by mass of inorganic fine particles ($SnO_2$, number average primary particle diameter: 100 nm), 100 parts by mass of a radically polymerizable polyfunctional compound (SR350, trimethylolpropane trimethacrylate, manufactured by Sartomer Company), 400 parts by mass of a solvent: 2-butanol, and 40 parts by mass of a solvent: tetrahydrofuran (THF) were mixed and dispersed for five hours using a sand mill as a dispersing machine. Thereafter, 10 parts by mass of a polymerization initiator: IRGACURE819 was added thereto and stirred and dissolved therein under light shielding to prepare a protective layer forming coating liquid. This protective layer forming coating liquid was applied onto the charge transporting layer using a circular slide hopper applicator to form a coating film. The coating film was irradiated with an ultraviolet ray for one minute using a metal halide lamp to form a protective layer having a dry film thickness of 3.0 μm. A photoreceptor was thereby manufactured.

<Manufacture of Photoreceptor Used in Image Forming Methods 2, 3, and 8 to 13>

A photoreceptor was manufactured in a similar manner to the above image forming method 1 and the like except that the type and number average primary particle diameter of inorganic fine particles to be added were changed as illustrated in Table I. Note that the universal hardness of a surface of the protective layer according to an embodiment of the present invention was adjusted by changing the type and number average primary particle diameter of inorganic fine particles to be added.

<Manufacture of Photoreceptor Used in Image Forming Method 4>

A photoreceptor was manufactured in a similar manner to the above image forming method 1 and the like except that the type of a polymerizable monomer to be added (the radically polymerizable polyfunctional compound) was changed. As the polymerizable monomer, dipentaerythritol hexaacrylate (DPHA) (manufactured by Shin-Nakamura Chemical Co., Ltd.) was used.

<Manufacture of Photoreceptor Used in Image Forming Method 5>

100 parts by mass of inorganic fine particles ($SnO_2$, number average primary particle diameter: 100 nm), 100 parts by mass of a polycarbonate resin (Z300, manufactured by Mitsubishi Gas Chemical Company, Inc.), 400 parts by mass of a solvent: toluene, and 40 parts by mass of a solvent: tetrahydrofuran (THF) were mixed. The resulting mixture was dispersed for five hours using a sand mill as a dispersing machine to prepare a protective layer forming coating liquid. This protective layer forming coating liquid was applied onto a charge transporting layer using a circular slide hopper applicator to form a coating film. Thereafter, the coating film was heated at 120° C. for 70 minutes to form a protective layer having a dry film thickness of 3.0 μm. A photoreceptor was thereby manufactured.

<Manufacture of Photoreceptor Used in Image Forming Method 6>

A photoreceptor was manufactured in a similar manner to the above image forming method 5 except that a protective layer forming coating liquid was prepared without adding inorganic fine particles.

<Manufacture of Photoreceptor Used in Image Forming Method 7>

A photoreceptor was manufactured in a similar manner to the above image forming method 1 and the like except that a protective layer forming coating liquid was prepared without adding inorganic fine particles.

<Manufacture of Photoreceptor Used in Image Forming Methods 20 and 21>

A photoreceptor obtained by performing up to formation of a charge transporting layer without forming a protective layer was used as a photoreceptor used in the image forming methods 20 and 21.

<Image Forming Device Used in Image Forming Method 1>

As an evaluation machine, an image forming device including the charge eliminator 10, the charging roller 11, the exposer 12, the developer 13, the pre-transfer charge eliminator 14, the transferer 15, the separator 16, the fixer 17 and the cleaner 18 illustrated in FIG. 2 was prepared. Specifically, as a charger of an image forming device "bizhub press C1070" (manufactured by Konica Minolta Inc.), a roller charging method was adopted. Furthermore, as a pre-transfer charge eliminator that exposes a surface of a photoreceptor to light and eliminates charges on the surface of the photoreceptor between a developer and a transferer, an LED light emitting device was mounted. Light emitted by this LED light emitting device had an emitted light center wavelength of 660 nm. In addition, as a photoreceptor for forming images of yellow, magenta, cyan, and black, the photoreceptor used in the image forming method 1 manufactured above was mounted and adopted as an image forming device used in the image forming method 1.

In the pre-transfer charge eliminator, pre-transfer charge elimination was performed under a condition that a potential Va of a portion (non-image portion) where toner was not attached on a toner image on a developed photoreceptor and a surface potential Vb of a portion (image portion) where toner was attached beyond the toner satisfied $Va \leq Vb$, that is, a condition that a difference in potential $|Va-Vb|$ after charge elimination was 0 [V] or more.

<Image Forming Device Used in Image Forming Methods 2 to 22>

An image forming device used in the image forming methods 2 to 20 was prepared in a similar manner to the image forming device used in the image forming method 1 except that the photoreceptor to be mounted was changed to the photoreceptor used in the image forming methods 2 to 20.

An image forming device used in the image forming methods 21 and 22 was prepared in a similar manner to the image forming device used in the image forming method 1 except that the photoreceptor to be mounted was changed to the photoreceptor used in the image forming methods 21 and 22 and that the pre-transfer charge eliminator was not disposed.

<Measurement of Universal Hardness of Protective Layer of Each Photoreceptor>

The universal hardness of a protective layer of each photoreceptor was measured by a pushing test under an environment of temperature of 20° C./50% RH. The universal hardness of a protective layer of each photoreceptor is illustrated in Table I.

Specifically, as a method for measuring the universal hardness, by applying a load F to a diamond quadrangular pyramid Vickers indenter under a test load with a universal hardness meter (an ultrafine hardness test system "Fischer Scope H100" (manufactured by Fischer Instruments K.K.)", a surface of a protective layer was pushed, and the universal hardness was determined as a universal hardness HU ($N/mm^2$) according to the following formula (A) using a pushing depth h and the load F. A Vickers indenter (quadrangular pyramid indenter, angle) 136°, a pushing speed of 0.2 (mN/sec), a pushing load of 2 (mN), holding time of 5 seconds, measurement environment of 20° C. and 50% RH were used as measurement conditions.

$$HU(\text{universal hardness})=F/(26.45\times h^2) \quad \text{Formula (A):}$$

<Evaluation>

In each image forming method, each photoreceptor was irradiated with light with energy of light illustrated in Table I in order to perform pre-transfer charge elimination. Note that pre-transfer charge elimination was not performed in the image forming methods 21 and 22 not including a pre-transfer charge eliminating step.

As an exposure light source of each image forming device, a semiconductor laser having a wavelength of 780 nm was used.

Evaluation of transfer memory performance and toner dust were performed by evaluating image quality of an output image. Subsequently, a durability test in which a character image having an image ratio of 5% was printed on one side of each of 300,000 A4 size sheets under an environment of temperature of 20° C. and humidity of 50% was performed, and then the abrasion amount of a photoreceptor was evaluated. The abrasion amount of a photoreceptor was calculated from a difference between an initial film thickness and a film thickness after the durability test.

<Evaluation of Abrasion Amount>

The difference in thickness of a photoreceptor before and after the durability test was calculated as a depletion amount (μm). The film thickness of a photoreceptor was measured using an eddy current type film thickness measuring instrument (film thickness meter FMP30, manufactured by Fischer Instruments K.K.). The film thicknesses of a photoreceptor were measured at intervals of 10 mm between a position of 10 mm from an upper end and a position of 10 mm from a lower end, and an average value thereof was taken as the film thickness of the photoreceptor.

Evaluation criteria were set as follows. Here, ranks 5 to 3 were evaluated as being acceptable, and ranks 2 and 1 were evaluated as being non-acceptable.

Rank 5: Depletion amount≤0.2 μm
Rank 4: 0.2 μm<Depletion amount≤0.3 μm
Rank 3: 0.3 μm<Depletion amount≤0.4 μm
Rank 2: 0.4 μm<Depletion amount≤0.5 μm
Rank 1: 0.5 μm<Depletion amount <Evaluation of Transfer Memory>

Transfer memory was evaluated using a photoreceptor before the durability test.

For evaluation of transfer memory, a green triangular chart was printed on A3 size "POD gross coated paper (100 g/m$^2$)" (manufactured by Oji Paper Co., Ltd.) under a low temperature and low humidity environment at temperature of 10° C. and humidity of 15%. A difference in density between an image portion corresponding to the first rotation of a photoreceptor and an image portion corresponding to the second rotation of the photoreceptor was measured and evaluated. The difference in density was measured with a transmission densitometer (TD-904 manufactured by Macbeth Co.). Evaluation criteria were set with five ranks according to a difference in density. Here, ranks 5 to 3 were evaluated as being acceptable, and ranks 2 and 1 were evaluated as being non-acceptable.

Rank 5: difference in density≤0.02
Rank 4: 0.02<difference in density≤0.05
Rank 3: 0.05<difference in density≤0.10
Rank 2: 0.10<difference in density≤0.15
Rank 1: 0.15<difference in density <Evaluation of Toner Dust>

Toner dust was evaluated using a photoreceptor before the durability test.

In evaluation of toner dust, a monochromatic thin line chart of 1200 dpi and 8 dots was printed on A3 size "POD gross coated paper (100 g/m$^2$)" (manufactured by Oji Paper Co., Ltd.) under a low temperature and low humidity environment at temperature of 10° C. and humidity of 15%, and the amount of toner scattered on both sides of the thin line was evaluated.

As evaluation criteria, five arbitrary thin lines in the monochromatic thin line chart were selected, the number of portions of the toner scattered in the surroundings in a range of a length of 5 mm in the selected thin line was counted, and the average number of the values at the five places was ranked in the following five stages. Here, ranks 5 to 3 were evaluated as being acceptable, and ranks 2 and 1 were evaluated as being non-acceptable.

Rank 5: number≤10
Rank 4: 10<number≤20
Rank 3: 20<number≤30
Rank 2: 40<number≤50
Rank 1: 50<number <Evaluation of Charging Stability>

Charging stability was evaluated using a photoreceptor after the durability test.

A monochromatic full-surface half image was printed on A3 size "POD gross coated paper (100 g/m$^2$)" (manufactured by Oji Paper Co., Ltd.) under an environment of temperature of 20° C. and humidity of 50%, and the degree of white spot due to charging failure was evaluated.

As evaluation criteria, the evaluation criteria were set with five ranks according to the number of white-spotted stripes (white stripes) resulting from charging failure. Here, ranks 5 to 3 were evaluated as being acceptable, and ranks 2 and 1 were evaluated as being non-acceptable.

Rank 5: The number of stripes is 0
Rank 4: The number of stripes is 1 or 2
Rank 3: The number of stripes is 3 to 5
Rank 2: The number of stripes is 6 to 10
Rank 1: The number of stripes is 11 or more

TABLE 1

| | Photoreceptor | | | | Pre-transfer charge elimination | |
|---|---|---|---|---|---|---|
| | Protective layer | | | | | |
| | | Inorganic fine particles | | | | |
| Image forming method | Resin | Type | Number average primary particle diameter [nm] | Universal hardness [N/mm$^2$] | Energy of light [μW/mm$^2$] | Charging method |
| 1 | Methacrylic resin | $SnO_2$ | 100 | 310 | 50 | Roller |
| 2 | Methacrylic resin | $SiO_2$ | 100 | 230 | 50 | Roller |
| 3 | Methacrylic resin | $TiO_2$ | 100 | 300 | 50 | Roller |
| 4 | Acrylic resin | $SnO_2$ | 100 | 300 | 50 | Roller |
| 5 | Polycarbonate resin | $SnO_2$ | 100 | 220 | 50 | Roller |
| 6 | Polycarbonate resin | — | — | 180 | 50 | Roller |
| 7 | Methacrylic resin | — | — | 190 | 50 | Roller |
| 8 | Methacrylic resin | $SnO_2$ | 5 | 200 | 50 | Roller |
| 9 | Methacrylic resin | $SnO_2$ | 10 | 220 | 50 | Roller |
| 10 | Methacrylic resin | $SiO_2$ | 200 | 320 | 50 | Roller |
| 11 | Methacrylic resin | $SnO_2$ | 500 | 330 | 50 | Roller |
| 12 | Methacrylic resin | $TiO_2$ | 500 | 350 | 50 | Roller |
| 13 | Methacrylic resin | $SnO_2$ | 1000 | 370 | 50 | Roller |
| 14 | Methacrylic resin | $SnO_2$ | 100 | 310 | 0.00005 | Roller |
| 15 | Methacrylic resin | $SnO_2$ | 100 | 310 | 0.0001 | Roller |
| 16 | Methacrylic resin | $SnO_2$ | 100 | 310 | 0.01 | Roller |
| 17 | Methacrylic resin | $SnO_2$ | 100 | 310 | 500 | Roller |
| 18 | Methacrylic resin | $SnO_2$ | 100 | 310 | 550 | Roller |
| 19 | Methacrylic resin | $SnO_2$ | 100 | 310 | 1000 | Roller |
| 20 | — | — | — | — | 50 | Roller |
| 21 | — | — | — | — | — | Roller |
| 22 | Methacrylic resin | $SnO_2$ | 100 | 310 | — | Roller |

TABLE 1-continued

| Image forming method | Evaluation item: Abrasion of photoreceptor | Transfer memory | Toner dust | Charging stability | Note |
|---|---|---|---|---|---|
| 1 | 5 | 5 | 5 | 5 | Present invention |
| 2 | 5 | 5 | 5 | 5 | Present invention |
| 3 | 5 | 5 | 5 | 5 | Present invention |
| 4 | 5 | 5 | 5 | 5 | Present invention |
| 5 | 4 | 5 | 5 | 4 | Present invention |
| 6 | 3 | 5 | 5 | 3 | Present invention |
| 7 | 3 | 5 | 5 | 3 | Present invention |
| 8 | 4 | 5 | 5 | 5 | Present invention |
| 9 | 4 | 5 | 5 | 5 | Present invention |
| 10 | 5 | 5 | 5 | 5 | Present invention |
| 11 | 4 | 5 | 5 | 5 | Present invention |
| 12 | 4 | 5 | 5 | 5 | Present invention |
| 13 | 3 | 5 | 5 | 3 | Present invention |
| 14 | 4 | 2 | 5 | 2 | Comparative Example |
| 15 | 5 | 4 | 4 | 4 | Present invention |
| 16 | 5 | 5 | 5 | 5 | Present invention |
| 17 | 5 | 4 | 4 | 4 | Present invention |
| 18 | 5 | 4 | 2 | 4 | Comparative Example |
| 19 | 5 | 3 | 1 | 4 | Comparative Example |
| 20 | 1 | 5 | 5 | 2 | Comparative Example |
| 21 | 1 | 2 | 5 | 1 | Comparative Example |
| 22 | 5 | 1 | 5 | 2 | Comparative Example |

As can be seen from the results in Table I, it has been found that the image forming method according to an embodiment of the present invention can improve transfer memory tolerance deteriorated when a roller charging method is adopted and charging stability at the time of endurance in photographing while suppressing abrasion of a photoreceptor. In addition, the image forming method according to an embodiment of the present invention can also suppress generation of toner dust. Meanwhile, the image forming method in Comparative Example was inferior to the image forming method according to an embodiment of the present invention in any one of the items.

According to an embodiment of the present invention, it is possible to provide an image forming method and an image forming device capable of improving transfer memory tolerance deteriorated when a roller charging method is adopted and charging stability at the time of endurance in photographing while suppressing abrasion of a photoreceptor.

An exhibition mechanism or an action mechanism of the effect according to an embodiment of the present invention has not been clarified but is estimated as follows.

A reason why adoption of the roller charging method tends to cause abrasion of a surface of a photoreceptor is that the surface of the photoreceptor is chemically deteriorated by discharge between a charging member and the photoreceptor when the photoreceptor is charged, and strength is reduced.

In addition, a reason why transfer memory tolerance is deteriorated is that electrons injected into a film of the photoreceptor are trapped by similar discharge, a positive electric field is applied to the electrons due to primary transfer in a non-image portion where there is no exposure to light while the electrons are trapped, and a transfer current thereby flows excessively into the non-image portion in comparison with an image portion.

Furthermore, contamination of a charging roller to reduce charging stability is generated by uneven abrasion of the photoreceptor or a cleaning blade. If the strength of the photoreceptor is too high, the cleaning blade is unevenly abraded. If the strength of the photoreceptor is too low, the photoreceptor is unevenly abraded.

In the present invention, in spite of including a high-strength protective layer, a photoreceptor can achieve both suppression of contamination of a charging roller and improvement of transfer memory tolerance by a pre-transfer charge eliminator. The pre-transfer charge eliminator eliminates a difference in surface potential between an image portion and a non-image portion on the photoreceptor after development, and thereby makes the amount of flowing of a transfer current into each of the image portion and the non-image portion of the photoreceptor uniform in primary transfer. This makes it possible to eliminate an image forming history of the photoreceptor in the first round and to suppress transfer memory of image forming in the second round. Furthermore, primary transferability is improved by making the transfer current uniform. Therefore, a transfer residual toner is reduced, and uneven abrasion of a cleaning blade can be suppressed. This makes it possible to suppress reduction in charging stability due to contamination of a charging roller.

In addition, the pre-transfer charge eliminator cancels a surface potential immediately before primary transfer, and therefore toner dust tends to be generated disadvantageously. However, the toner dust can be suppressed by appropriately adjusting the amount of light for irradiation. Specifically, it is estimated that an effect of disposing the pre-transfer charge eliminator can be obtained and that generation of toner dust can be suppressed by setting energy of light for irradiation in the pre-transfer charge eliminating step in a range of 0.0001 to 500 $\mu W/mm^2$ on a surface of the photoreceptor. In a case where the amount of light is excessive, a difference in potential between the image portion and the non-image portion before transfer is completely eliminated, and a binding force for constraining toner on the photoreceptor to the image portion is eliminated. Therefore, it is considered that toner dust is easily generated. However, it is estimated that the effect according to an embodiment of the present invention is obtained while generation of toner dust is suppressed by setting the energy of the light for irradiation in the pre-transfer charge eliminating step to 500 $\mu W/mm^2$ or less.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming method that forms an image by performing charging, exposing, developing, and transferring in a rotation direction of a rotationally driven photoreceptor, wherein the charging is performed by a roller charging method, exposing a surface of the photoreceptor to light and eliminating charges on the surface of the photoreceptor are included between the developing and the transferring, the photoreceptor includes at least a charge transporting layer and a protective layer laminated on the charge transporting layer on a conductive support, energy of light for irradiation in the exposing the surface of the photoreceptor to light is in a range of 0.0001 to 500 $\mu W/mm^2$ on the surface of the photoreceptor, the protective layer contains a (meth)acrylic or polycarbonate resin and $SnO_2$ or $TiO_2$ inorganic fine particles, the inorganic fine particles have a number average primary particle diameter in a range of 5 to 500 nm, and a surface of the protective layer has a universal hardness in a range of 200 to 350 $N/mm^2$.

2. The image forming method according to claim 1, wherein the energy of the light for irradiation in the exposing the surface of the photoreceptor to light is in a range of 0.01 to 50 $\mu W/mm^2$ on the surface of the photoreceptor.

3. The image forming method according to claim 1, wherein the light for irradiation in the exposing the surface of the photoreceptor to light includes light having a wavelength in a range of 550 to 900 nm.

4. The image forming method according to claim 1, wherein the universal hardness is in a range of 230 to 320 $N/mm^2$.

5. The image forming method according to claim 1, wherein the inorganic fine particles have a number average primary particle diameter in a range of 10 to 500 nm.

6. An image forming device comprising: a charger; an exposer; a developer; and a transferer in a rotation direction of a rotationally driven photoreceptor, wherein the charger includes a charging roller, a pre-transfer charge eliminator that exposes a surface of the photoreceptor to light and eliminates charges on the surface of the photoreceptor is disposed between the developer and the transferer, the photoreceptor includes at least a charge transporting layer and a protective layer laminated on the charge transporting layer on a conductive support, energy of light for irradiation in the pre-transfer charge eliminator is in a range of 0.0001 to 500 $\mu W/mm^2$ on the surface of the photoreceptor, the protective layer contains a (meth)acrylic or polycarbonate resin and $SnO_2$ or $TiO_2$ inorganic fine particles, the inorganic fine particles have a number average primary particle diameter in a range of 5 to 500 nm, and a surface of the protective layer has a universal hardness in a range of 200 to 350 $N/mm^2$.

* * * * *